US006616306B1

(12) United States Patent
Tawil et al.

(10) Patent No.: US 6,616,306 B1
(45) Date of Patent: Sep. 9, 2003

(54) LINEAR MOVING PATTERN FOR ELLIPSOIDAL TYPE STAGE LIGHT

(75) Inventors: Joseph Tawil, Pacific Palisades, CA (US); Lee Conlon, Waterloo (AU)

(73) Assignee: GAMProducts, Inc., Hollywood, CA (US)

( * ) Notice: Subject to any disclaimer, the term of this patent is extended or adjusted under 35 U.S.C. 154(b) by 0 days.

(21) Appl. No.: 09/672,586

(22) Filed: Sep. 28, 2000

(51) Int. Cl.[7] ..... F21V 17/02

(52) U.S. Cl. ..... 362/320; 362/278; 362/307; 353/109

(58) Field of Search ..... 353/109; 362/278, 362/320, 280, 284, 307, 351, 360, 277, 293

(56) References Cited

U.S. PATENT DOCUMENTS 4,591,955 A * 5/1986 Kallay ..... 362/320
5,791,755 A * 8/1998 Henry et al. ..... 362/284

* cited by examiner

*Primary Examiner*—Stephen Husar

(74) *Attorney, Agent, or Firm*—William Michael Hynes; Townsend and Townsend and Crew LLP

(57) ABSTRACT

A gobo having linear motion is inserted to the narrow iris slot of a conventional ellipsoidal stage light. The linear moving pattern includes a housing, a drive roller and a motor, a return roller, and an endless pattern loop. The housing has a narrowed end for protruding into the instrument at the iris slot and holding the return roller on one side of the light. The housing has a broad end for mounting outside of the ellipsoidal stage light for holding the drive roller and motor at the other side of the light. The broad end of the housing has two spring-biased hinged clamps for clamping the linear moving pattern into a single unitary linear moving pattern iris insert. A first motor clamp holds the drive roller and motor in place. A second pattern clamp tensions and dimensions the endless pattern loop for extension into and out of the iris slot of the ellipsoidal light. The endless pattern loop is first threaded to the return roller and the return roller mounted to the narrow end of the housing. The drive roller and motor is threaded to the endless pattern loop, placed into the housing at the broad end, and locked into place by the motor clamp. The tension clamp is dropped over the endless pattern loop to dimension and tension the endless pattern loop at two parallel and linear runs on opposite sides of the iris slot. The unitary linear moving pattern iris insert is inserted to ellipsoidal stage lighting instrument at the iris slot for operation.

5 Claims, 4 Drawing Sheets

LINEAR MOVING PATTERN FOR ELLIPSOIDAL TYPE STAGE LIGHT

This invention relates to ellipsoidal stage lights and so-called linear moving patterns for projecting patterns from such lights. More particularly, a linear moving pattern attachment is disclosed which enables projection of a pattern having linear motion from such ellipsoidal stage lights.

BACKGROUND OF THE INVENTION

Ellipsoidal stage lights are old and well known. Specifically, these lights get their name from the ellipsoidal shape of their reflecting mirrors and their use of the two ellipsoidal foci. A brief explanation of this prior art technology is in order.

An ellipse drawn on a plane has a major axis and a minor axis. The ellipse is elongate in the direction of the major axis and defines two foci along this major axis. By rotating the ellipse, one obtains an ellipsoid. By cutting off one end of the ellipsoid beyond the second focus, the interior optics of an ellipsoidal stage light can be understood.

Specifically, the reflecting mirror of an ellipsoidal stage light is shaped interior of the ellipsoid about one focus of the ellipsoid. The lamp is placed at this focus. When the lamp is energized, light is received and reflected to the remaining second focus of the ellipsoid.

Naturally, projection to a target, such as a stage must occur. In an ellipsoidal light, the ellipsoid is cut or truncated at the end opposite the reflector, usually slightly beyond the secondary focus. Objective lenses of various kinds and designs are placed in the light beyond the second focus. A beam is then projected by the objective lenses from the light.

In a conventional ellipsoidal stage light, shutters are manipulated with respect to the second focus to trim the edges of light projected by the light. Ellipsoidal lights are unique in this ability to use shutters to trim the edges of their projected image; they are simple, inexpensive, and capable of precise edge control of their projected beams in their stage lighting function.

In stage or scene light design, it is sometimes necessary to project patterns. It was from this necessity that the so-called "gobo" was developed for use with ellipsoidal stage lights.

Very simply stated, ellipsoidal lights are usually provided with an iris slot at the vicinity of the second focus. By placing a pattern (sometimes called a "gobo"), typically in the form of a patterned sheet of metal, glass or temperature resistant film into the iris slot adjacent the second focus of the ellipsoidal light, a corresponding pattern is projected as a light image, usually towards a stage.

Moving patterns have been projected from such ellipsoidal lights. Unfortunately, the space available at the iris slot in the vicinity of the second focus is extremely limited. To date, only circularly moving patterns have been used with ellipsoidal lights. An example of a gobo having circularly rotating mounted patterns placed in the iris slot of an ellipsoidal light is sold under the trademark GAM TwinSpin II™ of Gam Products Inc. of Hollywood, Calif. In this particular gobo design, circular patterns rotate about the major axis of ellipsoidal light in the vicinity of the second focus. With the GAM TwinSpin II™, it is possible to have two patterns rotate in opposite directions.

Unfortunately, circularly rotating gobos produce circularly rotating patterns. While such circularly rotating patterns can be occasionally used in light design, they are out of step with the real world—where most patterns travel either horizontally—as in the case of clouds—or vertically—as in the case of rain (down) or fire (up).

To solve this problem for the lighting designer, there has been developed a product known as a projector. An example of such a projector is the GAM Scene Machine sold by Gam Products Inc. of Hollywood, Calif. In short, this projector uses the principle of a light with two foci to project scenes, such as clouds, rain, snow, and fire. Just as in the case of the ellipsoidal light, in this rather expensive dedicated projection instrument, the image to be projected is placed at the second focus of a two focal plane system.

When linearly moving images are desired in such projectors, it is known to use endless pattern loops of continuously rotating metal, or film to project such images. The endless pattern loops typically have a drive roller on one side the projector, a return roller on the opposite side of the projector, and two planar runs of projection material extending in the vicinity of the projectors second focus. Since such projectors are specially designed instruments, space in such instruments is generally of no concern. As a consequence, a relatively large projection rotator is used.

By registering one or the other of these planar linearly moving runs of projection material to the second focus of the projector, two separate effects occur. First, the linearly moving run of projection material coincident to the secondary focus has its linearly moving pattern projected by the projector. A corresponding linearly moving pattern of light is projected. Second, the run of projection material not coincident to the secondary focus acts only to attenuate or modulate the light projected. It primarily effects the brightness (or amplitude) of the projected light. Since it is out of the plane of the secondary focus, its image does not project. From such projectors, it is known to project light images of rain, snow, fire, clouds and the like.

Unfortunately, such projectors are large, specialty instruments. They require special mounting, with their own lighting design and operation techniques.

In what follows, we disclose a linear moving pattern for projecting linear motion that is adapted to the narrow confines of a conventional ellipsoidal stage light. In making this adaptation, we set forth the problem to be solved, as well as its solution. The reader will understand that the discovery of the problem to be solved can constitute invention. Therefore, in so far as the prior art does not set forth the problem that we solve, invention is claimed to that aspect.

SUMMARY OF THE INVENTION

A gobo having linear motion pattern projection is inserted to the narrow iris slot of a conventional ellipsoidal stage light. The linear moving pattern includes a housing, a drive roller and motor, a return roller, and an endless pattern loop. The housing has a narrowed end for protruding into the instrument at the iris slot and holding the return roller on one side of the light. The housing has a broad slot end for mounting outside of the ellipsoidal stage light for holding the drive roller and motor at the other side of the light. The broad slot end of the housing has two spring-biased hinged clamps for clamping the gobo into a single unitary linear moving pattern iris insert. A motor clamp holds the drive roller and motor in place. A pattern clamp tensions and dimensions the endless pattern loop for extension into and out of the iris slot of the ellipsoidal light. In assembly, the endless pattern loop is first threaded to the return roller and the return roller mounted to the narrow end of the housing. Second, the drive roller and motor is threaded to the endless pattern loop, placed into the housing at the broad slot end, and locked into place by the motor clamp. Third, the tension clamp is dropped over the endless pattern loop to dimension and tension the endless pattern loop at two parallel and linear runs on opposite sides of the iris slot between the drive roller and return roller. Fourth, the unitary linear moving pattern iris insert is inserted to ellipsoidal stage lighting instrument at the iris slot for operation. In operation, the motor rotates the drive roller relative to the housing to rotate the endless pattern loop. One linear run of the endless loop pattern is registered near the second focus of the instrument to project the desired linear pattern while the remaining linear run of the endless loop pattern attenuates the projected image. There results the ability to provide locally focused and conventional ellipsoidal stage lights with linearly moving projected patterns.

It will be understood that one or the other linear runs of the endless pattern loop can be at the focal plane. In this way apparently linear movement of the pattern will be changed (reversed).

An advantage of this apparatus and method is that it enables the lighting designer to easily place linearly moving projected patterns wherever an ellipsoidal light can be focused to a light design area. The bulk, added expenses and design inconvenience of specially designed projectors are not required for local linearly moving image projection.

An additional advantage of this apparatus is that the linear moving pattern can be easily interchanged among the ellipsoidal lights of a design. The linear moving pattern can be removable between ellipsoidal instruments until an optimal location is determined.

DESCRIPTION OF THE SPECIFIC EMBODIMENTS

Figure 1:
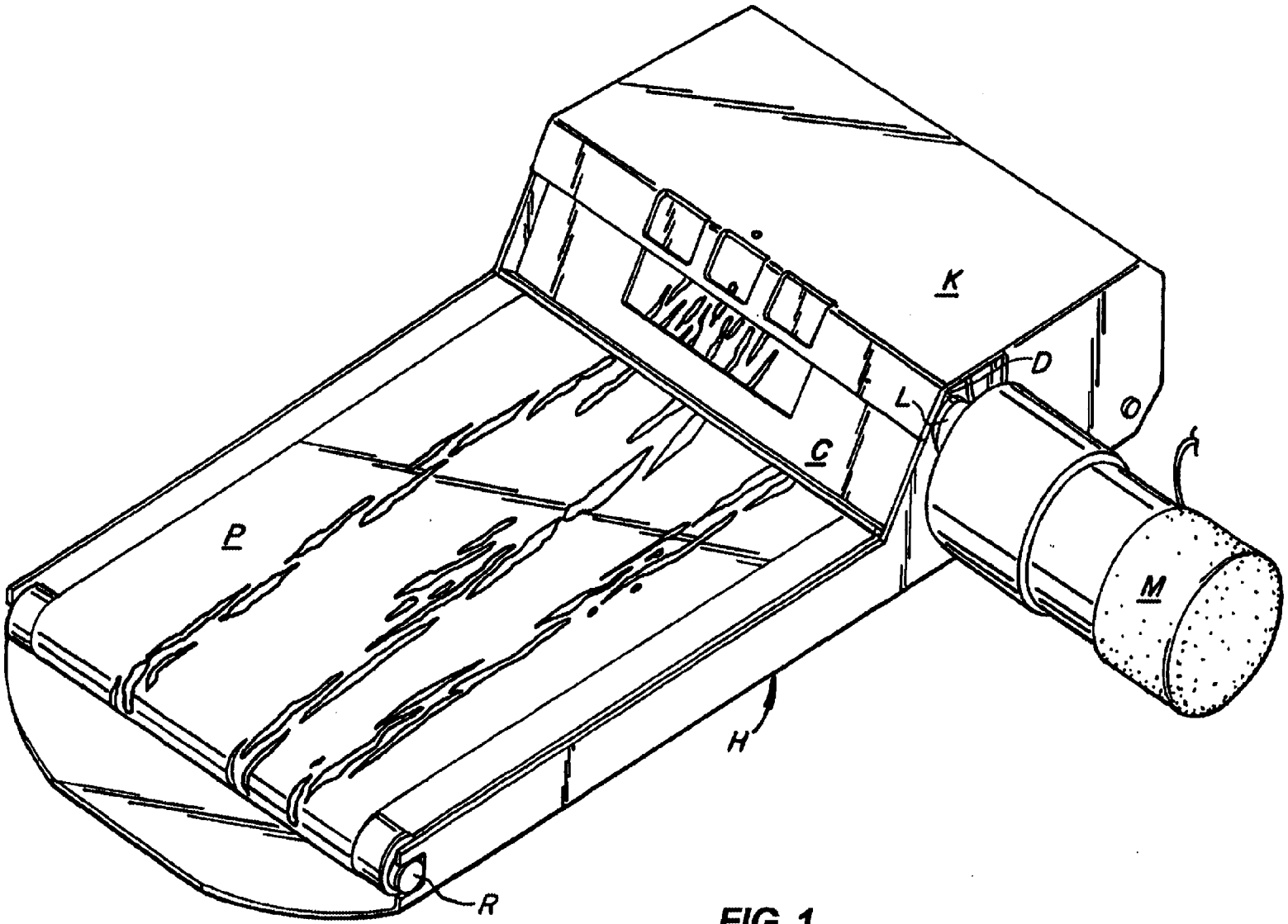
FIG. 1 is an assembled perspective view of the linearly moving pattern placed within a housing for mounting to the iris slot of a modern ellipsoidal stage light.

Referring to FIG. 1, housing H is shown having mounted thereto return roller R and drive motor M driving drive roller D. Drive roller D and return roller R dispose endless linear pattern P in a loop. Linear pattern P is confined by pattern clamp C to a narrow profile. A motor clamp K locks motor M and drive roller D into position to secure the unit as a unitary operating mechanism.

Figure 3:
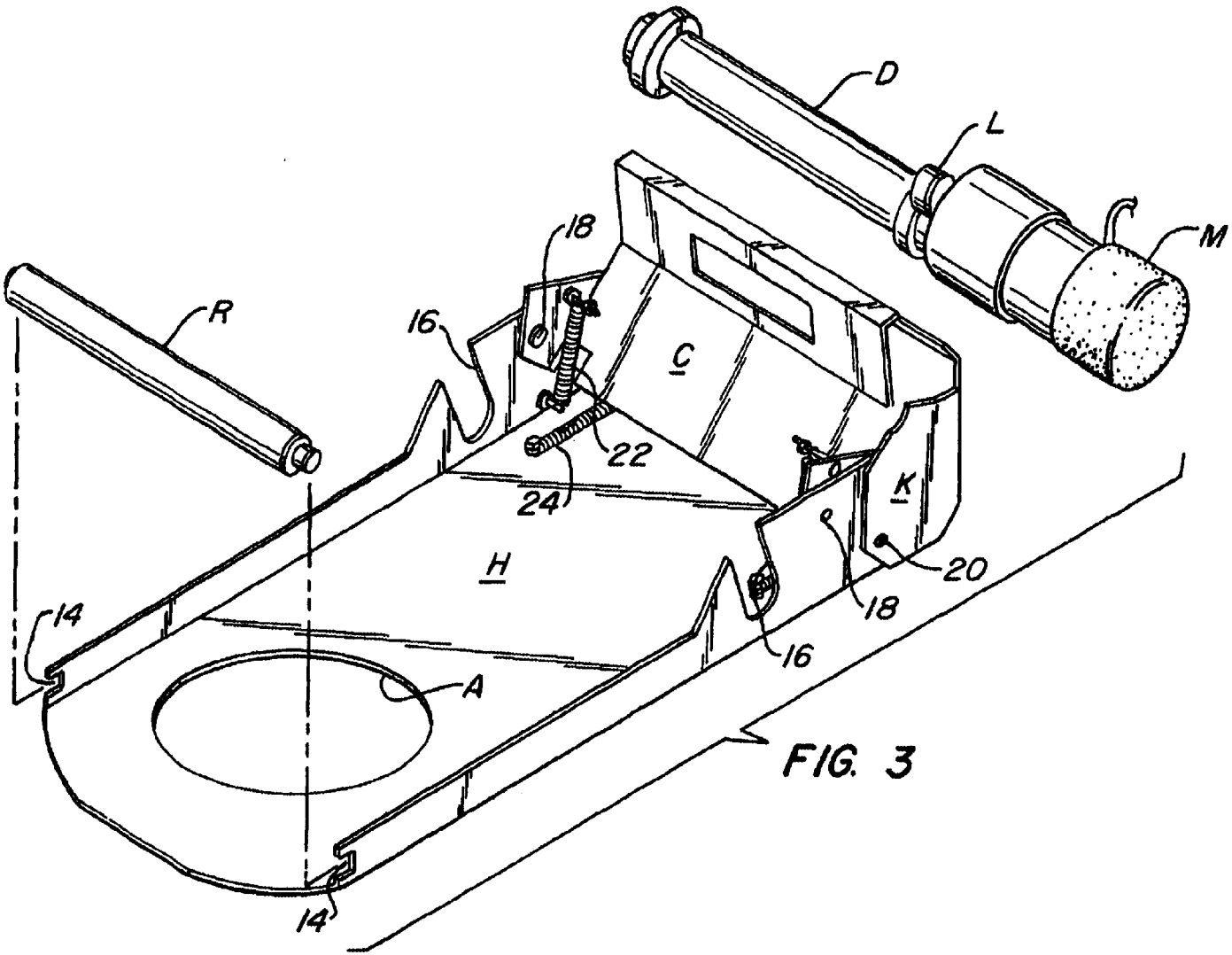
FIG. 3 illustrates the housing with the drive roller and return roller in the housing with the motor clamp and tensioning clamp opened away from the housing and without the endless pattern loop in the linear moving pattern.

Referring to FIG. 3, housing H is shown in detail. It includes aperture A through which light from an ellipsoidal lamp (later shown with respect to FIG. 4) can be projected. Housing H further includes return roller receiving slots 14 and drive roller receiving slots 16. Two hinged members pivot with respect to housing H. Pattern clamp pivots on hinge 18 and is over-center biased to the closed position by tension coil spring 22. Motor clamp K is pivoted by hinge 20 and over-center biased by tension coil springs 24.

Figure 2:
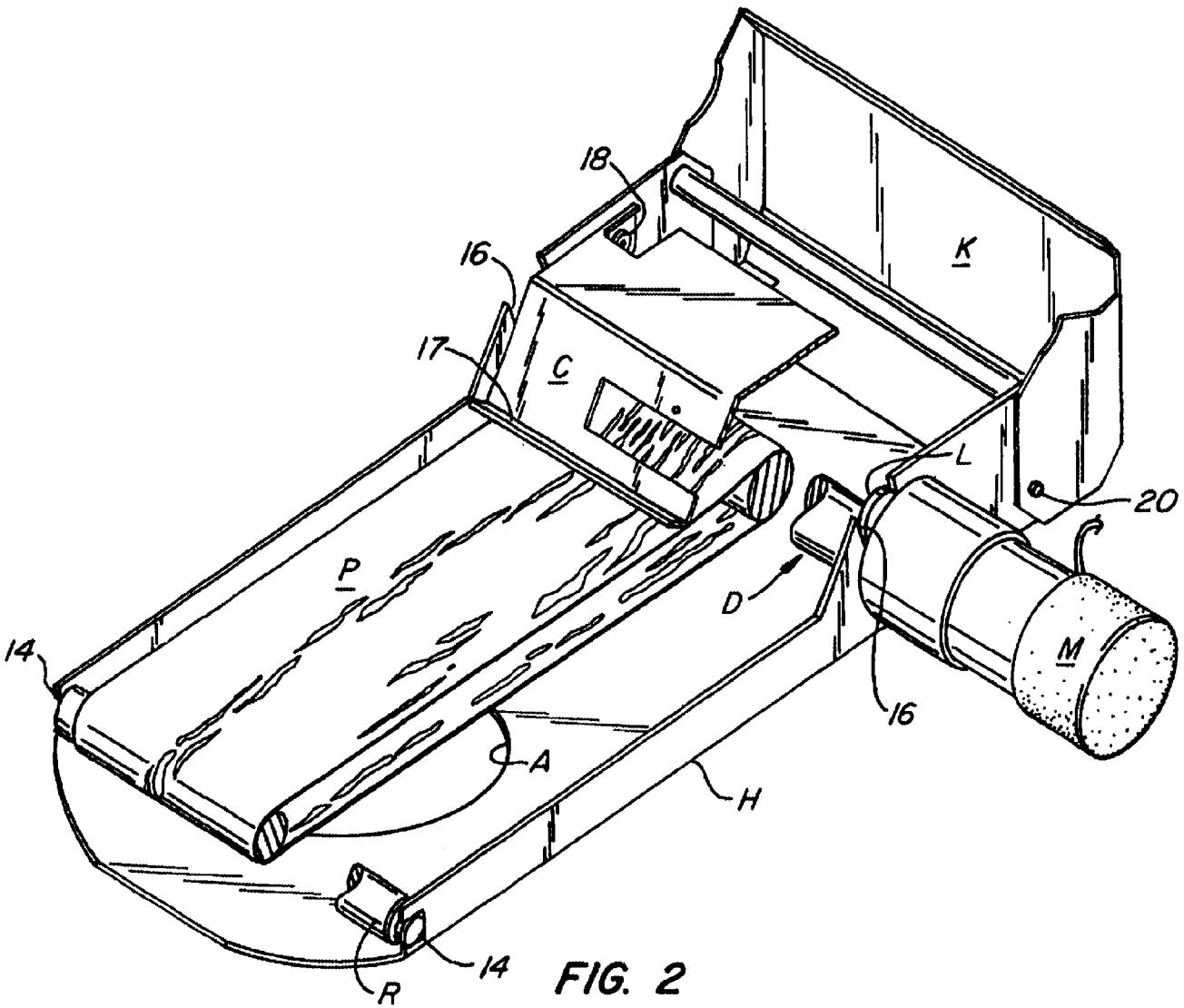
FIG. 2 is an illustration similar to FIG. 1 illustrating the apparatus in section showing the confinement of the linear moving pattern to a path which will fit into the iris slot of a modern ellipsoidal stage light.

Turning to FIG. 2, it will be seen that endless linear pattern P has been broken away in the illustrated section. With this broken away view, pattern clamp C can be seen folded onto endless linear pattern P at pattern contacting cam portion 17. The endless linear pattern P has its endless length controlled so that under the bias of pattern clamp C it has two elongate runs of material separated only by the relatively narrow diameter of return roller R. This enables the endless linear pattern to linearly move in the relative narrow confines of a iris slot in a conventional ellipsoidal stage lamp. Compression occurs so that the endless linear pattern in making continual excursion around drive roller D and return roller R is in effect confined to the iris slot ellipsoidal spotlight.

It will further be observed that lug L attached to motor M maintains the motor M stationary with respect to housing H. Thus, when motor M, acting through gearing (not shown) rotates drive roller D, such rotation occurs with respect to housing H. It will be seen that drive roller D has large flanges 11 bounding either side of drive roller D to maintain centering of endless loop pattern P.

As a further detail, it will be noted that the endless linear pattern P in effect holds return roller R to the return roller receiving slots 14. This function is provided by the co-action of pattern clamp C bearing down on pattern P as it makes its excursion under the impetus of drive roller D.

Figure 4:
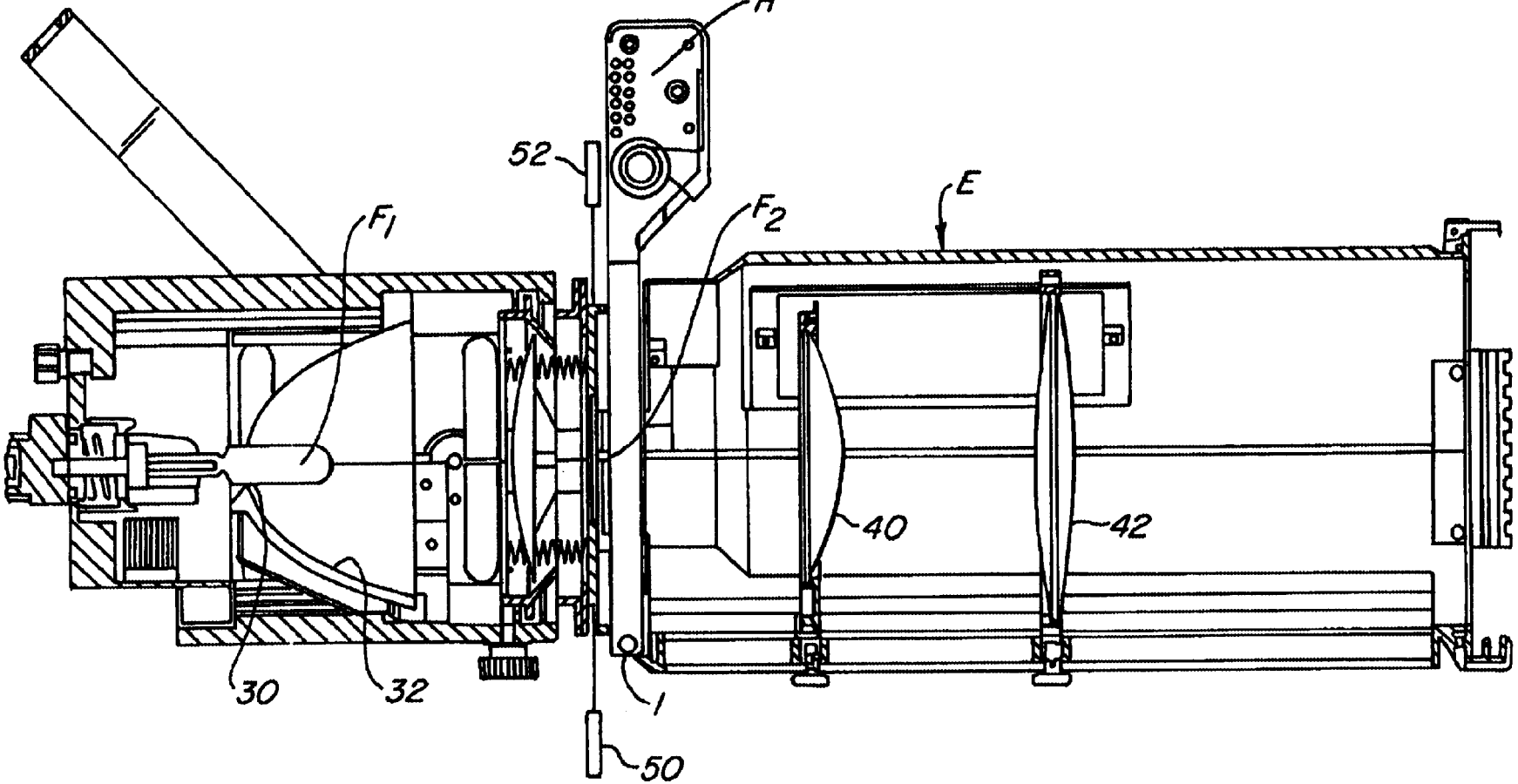
FIG. 4 illustrates a modern ellipsoidal light with the linear moving pattern of this invention installed to the iris slot of the instrument.

Reference is now made to FIG. 4 where ellipsoidal stage light E is shown in section. Specifically, lamp 30 internal of ellipsoidal-coated reflector 32 projects at first focus F1. Light from the filament of lamp 30 at first focus F1 passes to ellipsoidal-coated reflector 32. Ellipsoidal reflector 32 focuses light from lamp 30 at the first focus F1 to second focus F2. It is at this location that iris slot I is located.

Thereafter, light passes through downstream lenses 40, 42 for focus onto the object to be illuminated, typically a stage and associated scenery. At secondary focus F2, the lamp further includes movable shutters 50, 52, which provide the unique boarders to the edges of the projected light which are characteristic of an ellipsoidal stage light E. It will be understood that there typically are four such shutters for each lamp; the cross-section here illustrated only shows two of the four shutters. It will be understood that the pattern device of this invention does not interfere with the operation of these shutters.

It will be seen that housing H mounts to the iris slot I of the illustrated stage lamp E.

In operation, housing H is mounted to iris slot I of ellipsoidal stage lamp E. Thereafter, motor M is independently energized. When lamp 30 is illuminated, that portion of the endless linear pattern P passing adjacent second focal point F2 is projected. Light passing through that portion of the endless pattern away from focus F2 modulates the projected light.

It is thus seen that the ellipsoidal stage lamp E is supplied with a linear pattern which is capable of projection. The pattern here illustrated is of clouds. Other patterns, including snow, rain, fire and the like can be used.

What is claimed is:

1. A gobo having linear pattern motion from an endless pattern loop having a pattern for projection for insertion to the narrow iris slot in an ellipsoidal stage light comprising:

a drive roller and a motor for rotating the drive roller;

a return roller;

a housing, the housing having a narrowed end for protruding into the instrument at the iris slot and holding the return roller on one side of the light, the housing further having a broad end for mounting outside of the ellipsoidal stage light for holding the drive roller and motor at the other side of the light;

a motor clamp mounted to the housing for holding the drive roller and motor to the housing; and, a pattern clamp mounted to the housing to tension and dimension the endless pattern loop for extension into and out of the narrow iris slot about the housing.

2. The gobo having linear pattern motion for insertion to the narrow iris slot in an ellipsoidal stage light according to claim 1 and further comprising:

an endless pattern loop having a pattern for projection by the ellipsoidal stage light;

the endless pattern loop threaded to the return roller with the return roller mounted to the narrow end of the housing; and, the drive roller threaded to the endless pattern loop, placed into the housing at the broad end, and locked into place by the motor clamp.

3. Apparatus for projecting a pattern from an endless pattern loop comprising:

an ellipsoidal stage light having a light at a first focus and narrow iris slot at a second focus;

a drive roller and a motor for rotating the drive roller;

a return roller;

a housing, the housing having a narrowed end for protruding into the instrument at the iris slot and holding the return roller on one side of the light, the housing further having a broad end for mounting outside of the ellipsoidal stage light for holding the drive roller and motor at the other side of the light;

a motor clamp mounted to the housing for holding the drive roller and motor to the housing; and, a pattern clamp mounted to the housing to tension and dimension the endless pattern loop threaded about the drive roller and return roller for extension into and out of the narrow iris slot about the housing.

4. The apparatus for projecting a pattern from an endless pattern loop according to claim 3 and further including:

an endless pattern loop having a pattern for projection by the ellipsoidal stage light;

the endless pattern loop threaded to the return roller with the return roller mounted to the narrow end of the housing; and, the drive roller threaded to the endless pattern loop, placed into the housing at the broad end, and locked into place by the motor clamp.

5. A process from projecting from an ellipsoidal stage light an image having a linear moving pattern comprising the steps of:

providing a drive roller and a motor for rotating the drive roller;

providing a return roller;

providing a housing, the housing having a narrowed end for protruding into the instrument at the iris slot and holding the return roller on one side of the light, the housing further having a broad end for mounting outside of the ellipsoidal stage light for holding the drive roller and motor at the other side of the light;

mounting a motor clamp to the housing for holding the drive roller and motor to the housing;

mounting a pattern clamp to the housing to tension and dimension the endless pattern loop for extension into and out of the narrow iris slot about the housing;

providing an endless pattern loop having a pattern for projection by the ellipsoidal stage light;

threading the endless pattern loop to the return roller with the return roller mounted to the narrow end of the housing; and, threading the drive roller threaded to the endless pattern loop, placing the drive roller and motor into the housing at the broad end, and locking the drive roller into place with the motor clamp;

placing the housing at the narrow end into an iris slot of an ellipsoidal stage light;

tensioning and dimensioning the endless pattern loop threaded about the drive roller and return roller for extension into and out of the narrow iris slot about the housing; and, rotating the drive roller from the motor to rotate the dimensioned and tensioned endless loop pattern in the iris slot of the ellipsoidal stage light for projection of an image having linear motion.

* * * * *